US006884050B2

(12) United States Patent
Prior

(10) Patent No.: US 6,884,050 B2
(45) Date of Patent: Apr. 26, 2005

(54) ROOTS SUPERCHARGER WITH EXTENDED LENGTH HELICAL ROTORS

(75) Inventor: Gregory P. Prior, Birmingham, MI (US)

(73) Assignee: General Motors Corporation, Detroit, MI (US)

( * ) Notice: Subject to any disclaimer, the term of this patent is extended or adjusted under 35 U.S.C. 154(b) by 10 days.

(21) Appl. No.: 10/414,604

(22) Filed: Apr. 16, 2003

(65) Prior Publication Data

US 2004/0208770 A1 Oct. 21, 2004

(51) Int. Cl.[7] ..... F03C 2/00
(52) U.S. Cl. ..... 418/201.1; 418/206.4
(58) Field of Search ..... 418/201.1, 206.4

(56) References Cited

U.S. PATENT DOCUMENTS 2,463,080 A * 3/1949 Beier ..... 418/206.6
4,609,335 A * 9/1986 Uthoff, Jr. ..... 418/201.1
4,768,934 A * 9/1988 Soeters, Jr. ..... 418/201.1
5,078,583 A * 1/1992 Hampton et al. ..... 418/201.1

* cited by examiner

*Primary Examiner*—Theresa Trieu
(74) *Attorney, Agent, or Firm*—Leslie C. Hodges

(57) ABSTRACT

A Roots supercharger has an extended cavity with 103 mm diameter rotors having chambers defined by interleaved helical lobes with equal angular face offsets exceeding 60 degrees from inlet to outlet end faces angled in directions opposite to directions of rotor rotation. The chambers have angular seal times of less than 67 degrees of rotation. A preferred embodiment has a displacement of 122 cu mm/revolution, rotor length of 208 mm, face offsets of 65.3 degrees and seal time of 58.6 degrees. The rotor lobe helix angle is essentially 0.314 deg/mm, equal to the helix angle of a prior art supercharger with rotors of common diameter, displacement of 112 cubic inch/revolution, rotor length of 191 mm, previously considered maximum, 60 degree face offset, previously considered optimum, and seal time of 67 degrees. Both flow volumes and efficiency of the new configuration are improved from the prior art wherein the 60 degree face offset was considered optimum.

3 Claims, 4 Drawing Sheets

122 cu in 112 cu in

ROOTS SUPERCHARGER WITH EXTENDED LENGTH HELICAL ROTORS

TECHNICAL FIELD

This invention relates to automotive engine Roots superchargers having extended length helical rotors.

BACKGROUND OF THE INVENTION

Positive displacement superchargers of the Roots rotor type are sometimes used in automotive engines to increase the cylinder air charge and thus provide for increased engine output. The rotors may be formed with helical lobes to provide for axial air flow from an end wall inlet to an upper outlet adjacent an opposite end wall in order to improve efficiency and reduce noise.

There is commercially available a family of twisted, or helical, rotor Roots superchargers for use by engine manufacturers. These are based on a nominal 103 mm rotor diameter. Various displacements are produced by varying the lengths of the rotors. However, a different helix angle is used for each length, as it had been believed that a 60 degree offset between the front and rear faces of the rotors was optimum, independent of the rotor length.

It had also been believed that 191 mm was as long as rotors could be made for the 103 mm family due to thermal considerations between the inlet and outlet and to deflections of the rotor components.

The 191 mm rotor set results in a displacement of 112 cubic inch/revolution. For this design, the face offset from one end of the rotor to the other equals the previously considered optimum angle of 60 degrees, resulting in a helix angle twist of essentially 0.314 deg/mm. In addition, the seal time, expressed as the angular distance from closing of the inlet port connection from one rotor cavity to the opening of that cavity to the exhaust port, was 67 deg.

An engine application for a new project required greater air flow than the 112 cubic inch rotors could provide, so the design of a longer rotor was explored. Based upon earlier experience, it was believed that the 60 deg front-to-rear face offset would have to be maintained. However, this would have required new and expensive extrusion dies and rotor hobbing tools.

The inventor proposed instead that the rotors be simply lengthened to 208 mm without changing the helix angle of 0.314 deg/mm in order to minimize the expense. This yielded a 65.3 deg front-to-rear face offset and would yield a nominal 8.9% increase in displacement over the 112 cubic inch unit. This configuration resulted in a displacement of 122 cubic inches per revolution.

This new 122 cubic inch displacement unit did not have the 60 degree rotor face offset long believed to be optimal, but the unit was prototyped and tested as it was the most cost effective method to obtain the desired increased rotor displacement.

SUMMARY OF THE INVENTION

Tests of the resulting design showed that the new 122 cubic inch unit actually provided a 13% increase at peak air flow with improved efficiency and a lower temperature change (delta T). Thus, it is shown that the combination of a common helix angle with the 112 cubic inch unit, giving for the 122 cubic inch unit of the present invention a face offset of 65.3 deg and a rotor length of 208 mm, has provided superior air flow with higher efficiency than the previous design. It is presently conjectured that the longer rotor length and the high helix angle may provide a cooler inlet side that improves air flow and efficiency.

Thus, it has been shown that rotor face offsets of greater than 60 deg, previously considered objectionable, and rotor lengths in excess of 191 mm can provide improved performance over the prior art arrangements, which were limited to 60 deg face offsets. In accordance with the invention, the increase in face offset is shown to be effective at least up to 65.3 deg with a rotor length of 208 mm. The invention also includes a reduction of seal time from closing of the inlet opening to opening of the outlet port wherein the seal time is reduced to 58.6 deg from the previous design figure of 67 deg. The seal time is reduced in part by enlarging the inlet opening to provide for greater air flow into the rotor chambers through which air is carried from the inlet to the outlet of the supercharger housing.

It is possible that prior improvements in rotor coatings provided by the supercharger manufacturer may be in part responsible for the ability to obtain the increased performance of the present invention. It is considered likely that further testing of varying lengths and sizes of supercharger rotors could develop even greater improvements in the performance of superchargers in accordance with the invention.

These and other features and advantages of the invention will be more fully understood from the following description of certain specific embodiments of the invention taken together with the accompanying drawings.

DESCRIPTION OF THE PREFERRED EMBODIMENT

Figure 1:
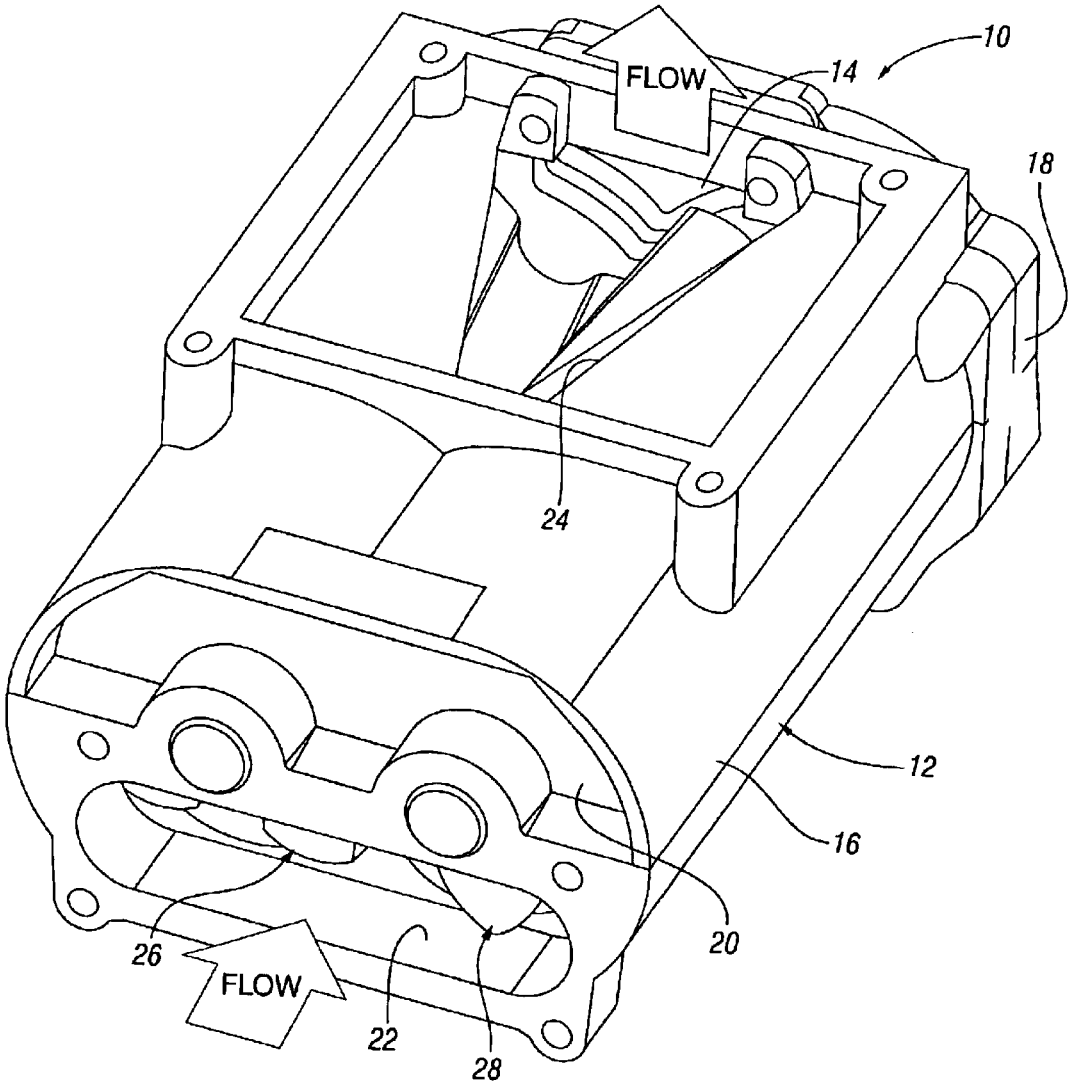
FIG. 1 is a pictorial view showing the exterior configuration of a helical rotor supercharger according to the present invention.

Referring first to FIG. 1 of the drawings in detail, numeral 10 generally indicates a positive displacement helical lobed supercharger according to the invention. Supercharger 10 includes a housing 12 having an internal cavity 14 defined by a surrounding wall 16 and front and rear end walls 18, 20, respectively. A generally rectangular inlet opening 22 in a lower portion of the rear end wall 20 communicates the cavity 14 with a source of inlet air, not shown. A generally V-shaped outlet opening 24 extends through the surrounding wall 16 adjacent the front end wall 18 of the housing and communicates the cavity 14 with a pressure charging air system, not shown.

Figure 2:
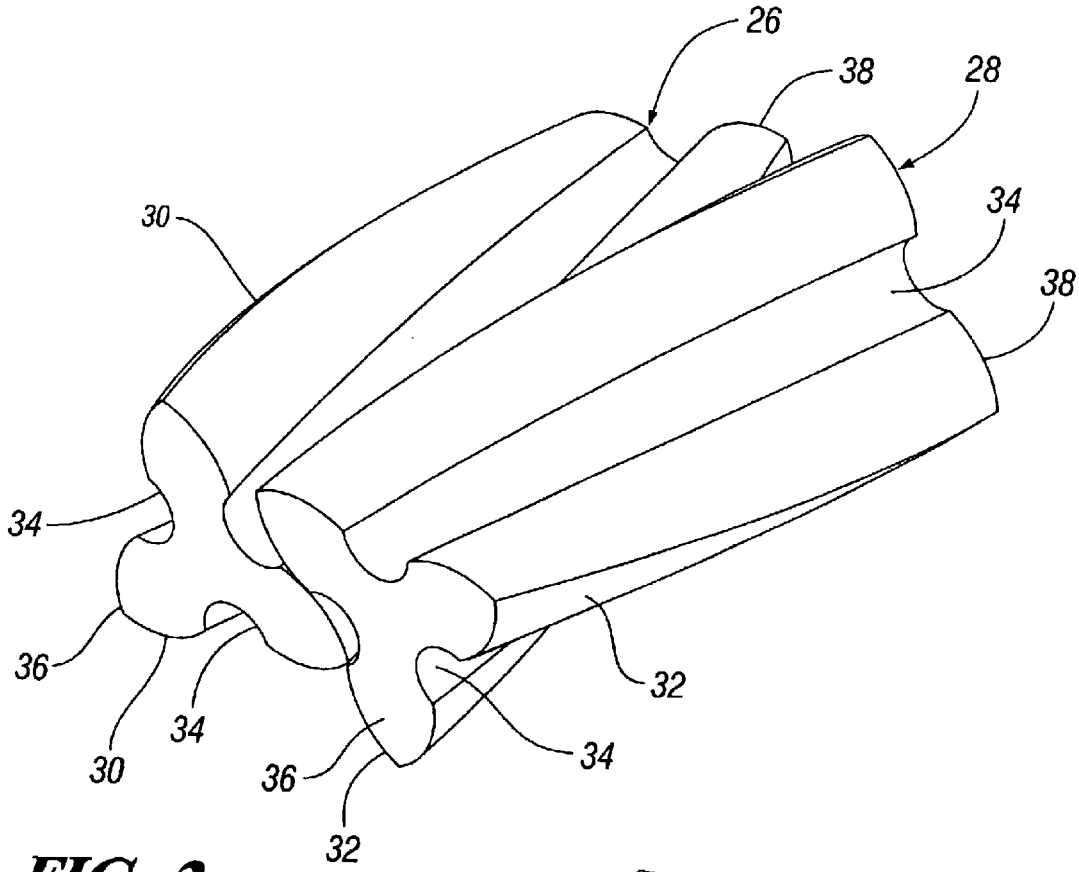
FIGS. 2 and 3 are pictorial views comparing helical rotors of the present invention in FIG. 2 with those of the prior art arrangement in FIG. 3.
Figure 4:
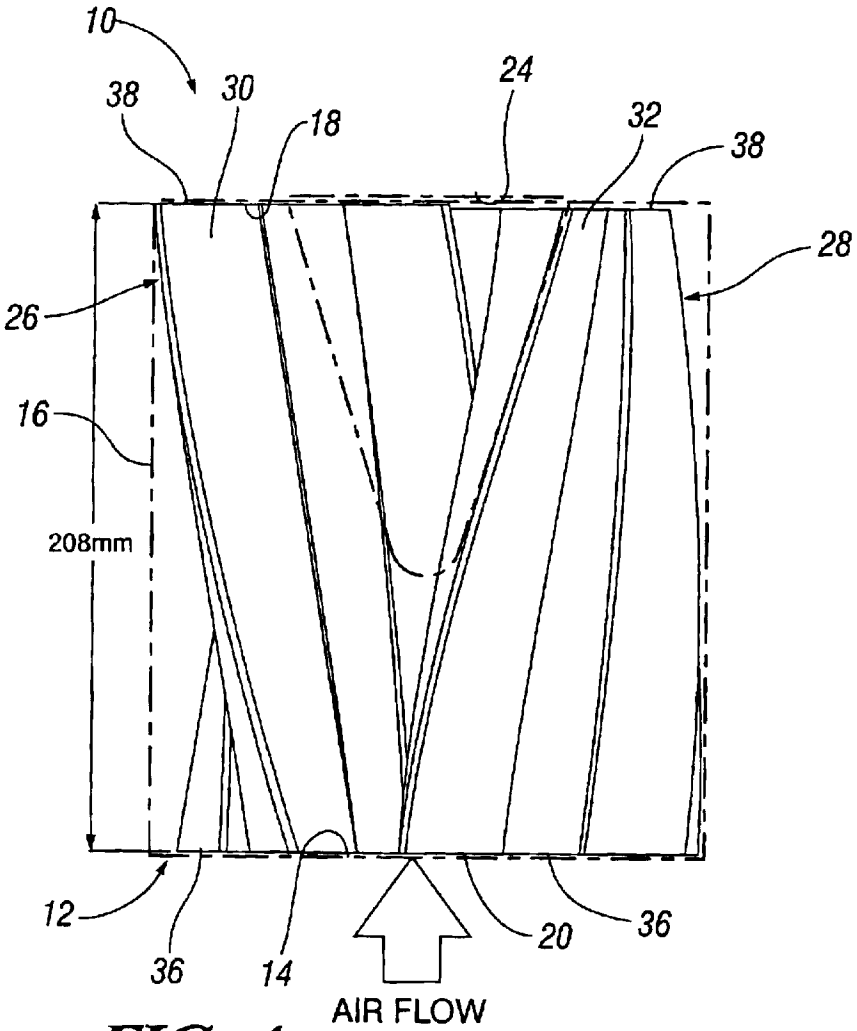
Figure 6:
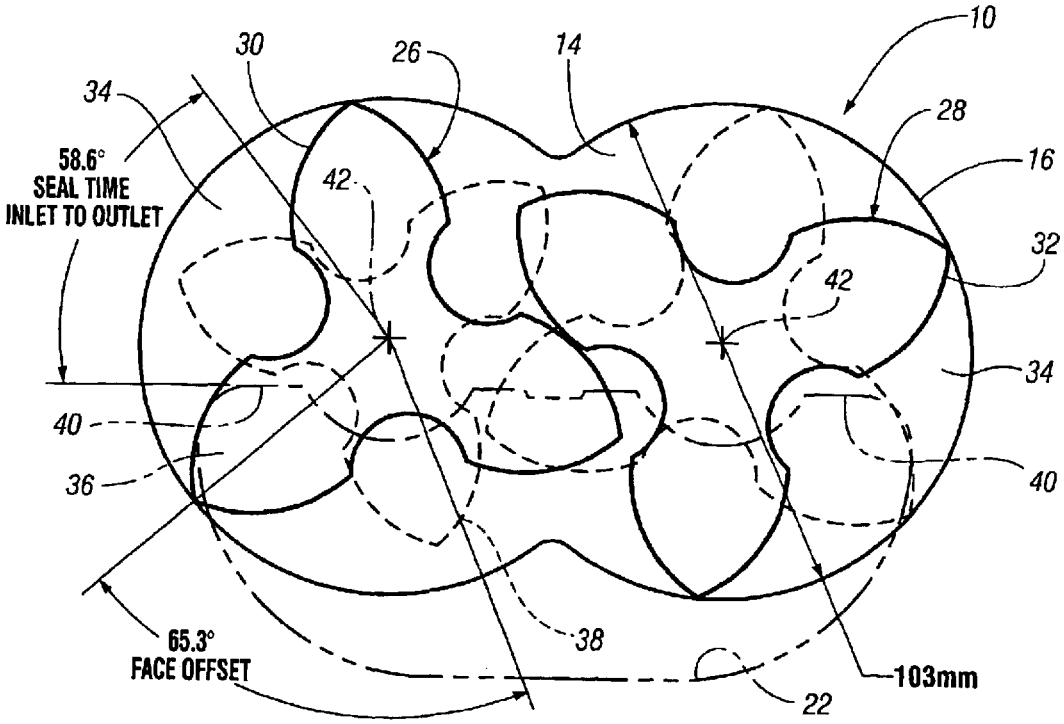
FIGS. 6 and 7 are inlet end, or rear end, views comparing other dimensional characteristics of the 122 cubic inch supercharger of the present invention in FIG. 6 with the 112 cubic inch prior art supercharger of FIG. 7.

Within the cavity 14 there are rotatably mounted a pair of supercharger rotors 26, 28 having lobes 30, 32 with opposite helix angles, as is better shown in FIGS. 2, 4, and 6. The lobes 30, 32 of the rotors are interleaved in assembly to define with the housing helical rotor chambers 34. In the illustrated embodiment, the rotor lobes are twisted with equal and opposite helix angles of approximately 0.314 deg/mm. The direction of twist of lobes 30 from the inlet end rear face 36 to the outlet end or front face 38 is counter-clockwise, while the direction of twist, or helical change, of the lobes 32 is clockwise. The outer diameter of the rotors is approximately 103 mm.

Figure 3:
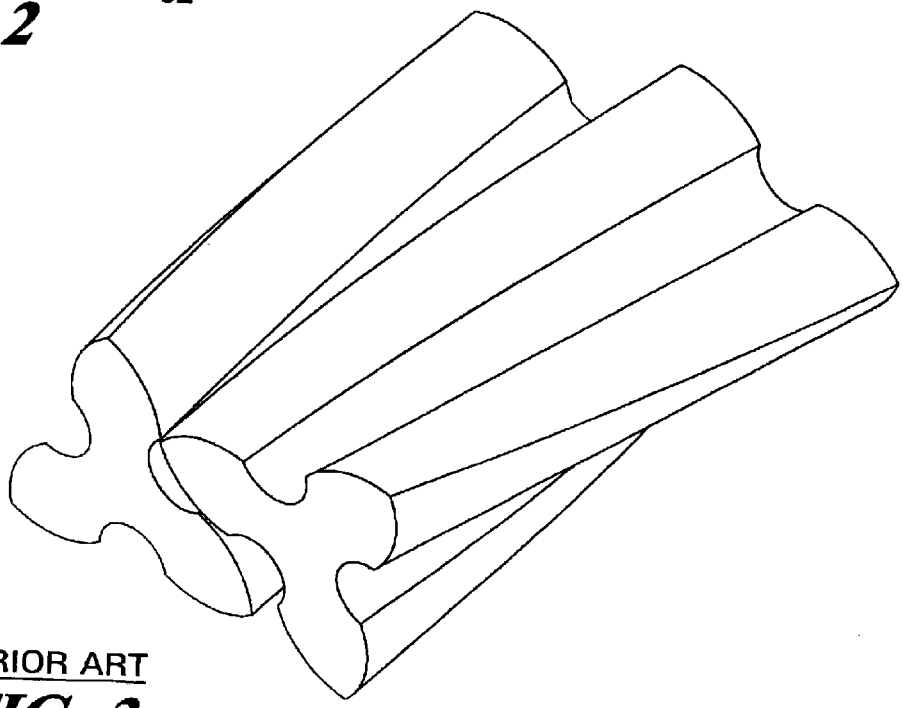
PRIOR ART FIG. 3
Figure 5:
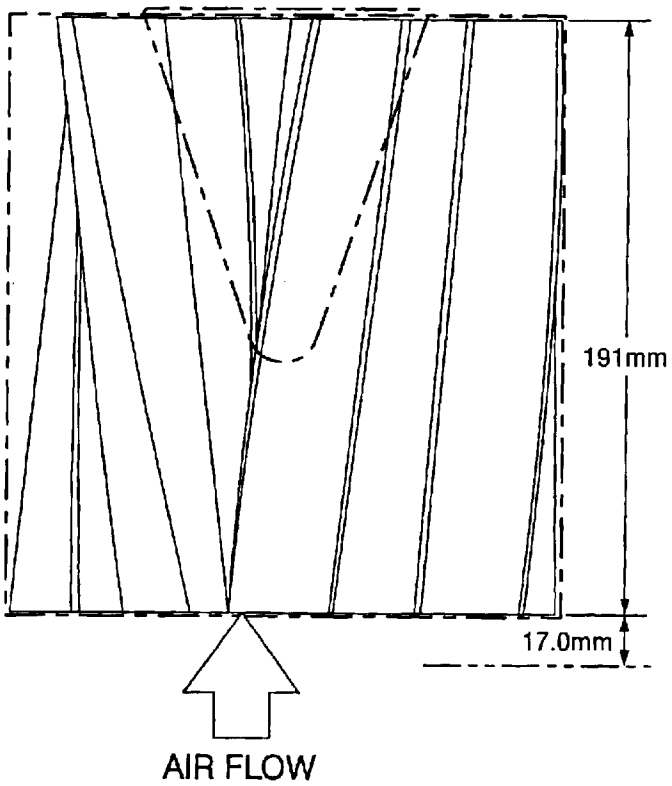
PRIOR ART FIG. 5
FIGS. 4 and 5 are top plan views with upper portions of the housing removed and illustrating the comparable lengths of the improved (FIG. 4) and prior art (FIG. 5) rotors as well as the locations of the outlet ports.

For comparison purposes, the dimensions of the prior art rotors shown in FIG. 3 are identical to those of the rotors of FIG. 2 except for the length, as is illustrated in FIGS. 4 and 5. The other dimensions, including the helix angle, are the same.

FIGS. 4 and 5 provide a comparison of the internal cavity 14 and the rotors 30, 32 mounted therein, as shown in FIG. 4 representing the present invention, with the comparable features of the prior art supercharger illustrated in FIG. 5. The length of the prior art rotors is approximately 191 mm while the rotors of the supercharger according to the present invention have been extended in length to 208 mm. The V-shaped outlet opening 24 is the same in both the prior art supercharger and that of the present invention.

Figure 7:
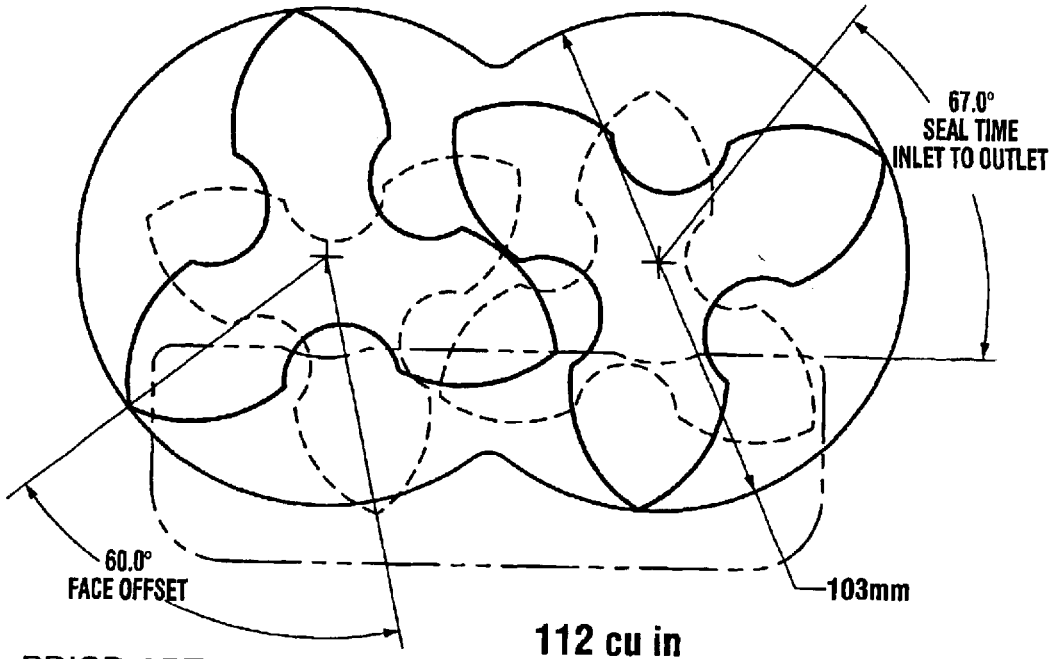
PRIOR ART FIG. 7

Reference to FIGS. 6 and 7 illustrates a comparison between supercharger 10 of the present invention and the smaller supercharger of the prior art illustrated in FIG. 7. As shown, the diameters of the rotors in both superchargers are the same. However, the angular face offset from the rear face 36 to the front face 38 of the same lobe 30 is 65.3 deg in the rotors of supercharger 10, while the comparable face offset of the prior art supercharger rotors is 60 deg. This is determined by the fact that the helix angles of the two embodiments are the same but the lengths of the rotors 30, 32 are greater, leading to an increased face offset between the rotor ends of the longer rotor.

A further difference of the present invention from the prior art is illustrated by the configuration of the inlet opening 22 of the present invention as compared to the opening of the prior art arrangement shown in FIG. 7. It will be noted that the upper edges 40 of the inlet opening 22 are higher, that is closer to the axes 42 of the rotors of supercharger 10, than the comparable upper edges of the inlet opening of the prior art embodiment. As a result, the angular seal time from closing of one of the rotor chambers 34, as it rotates from closing of the inlet port to opening of the rotor chamber as it reaches the outlet port 24, is reduced to 58.6 deg in supercharger 10 of the present invention as compared to 67 deg in the prior art embodiment of FIG. 7.

The mode of operation of both superchargers is essentially the same. During engine operation, the supercharger rotors are rotated in a direction to drawn in air from the inlet 22 at the rear face of the rotors and carry it forward in the chambers 34 to discharge through the outlet opening 24 to a higher pressure induction system of an associated engine, not shown.

Because the displacement of the larger 122 cubic inch supercharger according to the invention is approximately 8.9% greater than the displacement of the prior art 112 cubic inch supercharger, an increase of flow of approximately 8.9% might reasonably be expected. However, tests of the modified design actually showed an increase at maximum flow of 13% with both lower temperature increase and improved efficiency over the smaller 112 cubic inch supercharger of the prior art. This result indicates that the use of increased face offsets over the 60 deg angle limit of the prior art to at least 65.3 deg of the illustrated embodiment provides improved performance, at least when combined with a reduction in seal time from the 67 deg figure of the prior art toward the 58.6 deg figure of the illustrated embodiment of the invention.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A Roots supercharger for an internal combustion engine comprising:

a housing including a rotor cavity having a surrounding wall and opposite end walls, an inlet in one end wall and an outlet adjacent the opposite end wall;

a pair of positive displacement rotors oppositely rotatable in the rotor cavity and having interleaved helical lobes twisted with equal and opposite helix angles of approximately 0.314 deg/mm and forming chambers adapted to carry air axially from the inlet to the outlet;

the rotors having inlet and outlet end faces having face offsets wherein the outlet end faces are angularly offset from the inlet end faces by equal angles of greater than 60 degrees in directions opposite to directions of rotation of the rotors; and the rotor chambers having a rotational seal time of less than 67 degrees of rotation of the rotors between nominal closing of their connection with the inlet and nominal opening of their connection with the outlet.

2. A supercharger as in claim 1 wherein the rotors have equal lengths in the range of from 191 mm to 208 mm.

3. A Roots supercharger for an internal combustion engine comprising:

a housing including a rotor cavity having a surrounding wall and opposite end walls, an inlet in one end wall and an outlet adjacent the opposite end wall;

a pair of positive displacement rotors oppositely rotatable in the rotor cavity and having interleaved helical lobes forming chambers adapted to carry air axially from the inlet to the outlet;

the rotors having inlet and outlet end faces having face offsets wherein the outlet end faces are angularly offset from the inlet end faces by equal angles of greater than 60 degrees in directions opposite to directions of rotation of the rotors and the rotor chambers having a rotational seal time of less than 67 degrees of rotation of the rotors between nominal closing of their connection with the inlet and nominal opening of their connection with the outlet;

wherein the lengths of the rotors are 208 mm, the face offsets are 65.3 degrees and the seal time is 58.6 degrees.

* * * * *